United States Patent [19]

Wiseman

[11] Patent Number: 4,738,391

[45] Date of Patent: Apr. 19, 1988

[54] TEMPORARILY AND PERMANENTLY SEALABLE ENVELOPE OR THE LIKE

[76] Inventor: Robert F. Wiseman, 7180 Hill Rd., Roseville, Calif. 95661

[21] Appl. No.: 26,154

[22] Filed: Mar. 16, 1987

[51] Int. Cl.[4] ..... B65D 27/14

[52] U.S. Cl. ..... 229/80; 229/68 R; 229/82

[58] Field of Search ..... 229/80, 82, 84, 68 R, 229/79, 76

[56] References Cited

U.S. PATENT DOCUMENTS

| | | | |
|---|---|---|---|
| 2,224,604 | 12/1940 | Miehlke | 229/82 |
| 2,367,440 | 1/1945 | Schieman | 229/80 |
| 2,400,406 | 5/1946 | Godoy | 229/79 |
| 2,476,740 | 7/1949 | Krall | 229/80 |
| 2,601,946 | 7/1952 | Heywood | 229/80 |
| 3,265,289 | 8/1966 | Hiersteiner | 229/80 |
| 3,702,171 | 11/1972 | Levine | 229/80 |
| 4,192,448 | 3/1980 | Porth | 229/80 |

FOREIGN PATENT DOCUMENTS

| | | | |
|---|---|---|---|
| 2647357 | 4/1977 | Fed. Rep. of Germany . | |
| 1483501 | 4/1967 | France | 229/80 |
| 449402 | 4/1968 | Switzerland | 229/80 |
| 509353 | 7/1939 | United Kingdom | 229/80 |
| 934279 | 8/1963 | United Kingdom . | |

*Primary Examiner*—Willis Little

*Attorney, Agent, or Firm*—Schapp and Hatch

[57] ABSTRACT

A selectively temporarily and/or permanently sealable envelope or the like having a flap provided with a layer of wettable dry adhesive, a tab extending from the flap and having a layer of pressure sensitive adhesive, and means for selectively masking off, concealing and protecting the layer of pressure sensitive adhesive whereby the closure flap is selectively releasably securable to the container body by the pressure sensitive adhesive and is permanently securable to the container body by the wettable adhesive.

22 Claims, 3 Drawing Sheets

TEMPORARILY AND PERMANENTLY SEALABLE ENVELOPE OR THE LIKE

BACKGROUND OF THE INVENTION

1. Field of the Invention

This invention relates to containers having a closeable flap, such as envelopes, and more particularly to such devices having provisions for permanently sealing the flap shut with a wettable dry glue and temporarily sealing the flap shut with a pressure sensitive adhesive.

2. Description of the Prior Art (The term "prior art" as used herein, or in any statement by or on behalf of applicant, means *only* that any document or thing referred to as prior art bears directly or inferentially, a date which is earlier than the effective filing date hereof).

Envelopes, and similar containers having an opening bordered by a flap, have been known for many years. While occasionally mechanical devices, such as clasps, strings, and snap fasteners, are used for holding the flaps shut, it is much more popular to provide a layer of wettable dry adhesive on the inside of the flap which, when wetted, can be folded against the body of the container to secure the flap in closed position.

The wettable dry adhesive seal is permanent in nature and requires that the integrity of the envelope be destroyed in order to gain access to its contents. Since the advent of pressure sensitive adhesive, envelopes have been made with flaps bearing areas of pressure sensitive adhesive by which the envelope flap may be releasably secured in place a number of times so that the envelope may be used over and over again. Such envelopes are not suitable for mailing because of the ease with which they can be opened and the contents of the envelope removed.

Examples of envelopes having pressure sensitive adhesive on their flaps may be found in U.S. Pat. No. 2,367,440 to G. Schieman; U.S. Pat. No. 2,601,946 to V. Heywood; and U.S. Pat. No. 4,192,448 to E. Porth. Examples of tabs bearing pressure sensitive adhesive for temporary sealing of envelopes are found in U.S. Pat. No. 934,279 to R. Voysey; U.S. Pat. No. 2,400,406 to A. Godoy; U.S. Pat. No. 3,265,289 to W. Hiersteiner; and U.S. Pat. No. 3,712,171 to E. Levine.

Attempts have been made to make an envelope which can either be permanently or temporarily sealed. West German Patent No. 26 47 357 shows and describes an envelope having parallel adhesive bands, the first band being for permanent sealing and the second band being a pressure sensitive adhesive allowing repeated sealing of the envelope. French Patent No. 75 05716 shows and describes an envelope having a section of the flap covered with a pressure sensitive adhesive and two sections on the body of an envelope, one of the sections being coated with an adhesive which adheres permanently to the adhesive on the envelope flap, and the second section having an easy-release coating for temporary sealing.

In addition to the patents discussed above, it is believed that U.S. Pat. No. 2,224,604 to C. Miehlke contains information which is or might be considered to be material to the examination of this application. The cited patents are believed to be relevant to the present invention because they were reduced by a prior art search made by an independent searcher.

A copy of each of the above-listed and above-discussed patents is supplied to the Patent and Trademark office herewith.

No representation or admission is made that any of the enclosed documents is part of the prior art, in any acceptation of that term, or that no more pertinent information exists.

SUMMARY OF THE INVENTION

The envelope or the like of the present invention is capable of being used either to effect an easily releasable seal or to accomplish a permanent seal. Thus, the envelope may be transported in either permanently sealed or temporarily sealed condition and can be used repeated by utilizing the temporary sealing feature. This is accomplished by providing areas of pressure sensitive adhesive and wettable dry adhesive on the flap of the envelope in position for selective use of either or both areas to seal the flap to the container body.

The area of pressure sensitive adhesive and surrounding areas of wettable dry adhesive are carried on a tab extending from the distal edge of the flap of the envelope, or the area of pressure sensitive adhesive is positioned on the flap adjacent to the tab. In either case, the tab may be folded to conceal and protect the area of pressure sensitive adhesive when it is desired not to use same. For example, the tab is folded to conceal and protect the pressure sensitive area before use of the envelope, after use of the envelope with temporary sealing, etc. This prevents accidental adherence of the pressure sensitive adhesive to papers or other matter being placed in or removed from the envelope container.

The body of the envelope is provided with a layer of easy-release material at the area where the pressure sensitive adhesive contacts it. This assures repeated opportunity to seal the envelope in a temporary manner without causing the pressure sensitive adhesive to lose its "tackiness."

I have found that conventional wettable dry glue commonly used on envelopes does not adhere well to pressure sensitive adhesive. Therefore, when the tabs are folded over so that the pressure sensitive adhesive is concealed and protected between the tab and the adjacent flap of the envelope, the pressure sensitive adhesive area does not stick firmly to the dry glue area but instead releases easily without impairing the agressive adhesion qualities of the pressure sensitive adhesive. The tab is formed to facilitate grasping and lifting thereof without resorting to tools or other devices. This makes it possible for the envelope of the present invention to be converted readily from temporary sealing mode to permanent sealing mode and back again.

It is therefore a principal object of the present invention to provide a closure flap for an envelope or the like which is capable of being adhered either temporarily or permanently, as desired, to the envelope body.

Another object of the present invention is to provide an envelope or the like of the character described which may be used repeatedly in the temporary sealed mode, with the pressure sensitive adhesive area protected and concealed between such uses.

A further object of the present invention is to provide an envelope or the like of the character set forth having a flap extended to provide a tab capable of being folded back against the envelope flap for accomplishing the described concealment and protection of the pressure sensitive adhesive area.

A still further object of the present invention is to provide an envelope or the like of the character described in which the pressure sensitive adhesive area adheres to an easy-release surface both when folded back against the envelope flap and when extended into position for engaging the body of the envelope.

Yet another object of the present invention is to provide an envelope or the like of the character described in which the tab is provided with fold lines facilitating grasping and lifting of the tab from the flap surface and/or the surface of the envelope body.

Another object of the present invention is to provide an envelope or the like of the character set forth having perforated tear strip portions, by means of which the envelope flap may first be permanently sealed and then the permanently sealed portions detached from the flap to leave a tab having a pressure sensitive adhesive area for effecting a temporary seal to the envelope body.

Other objects and features of advantage will become apparent as the specification progresses and from the claims.

Figure 1:
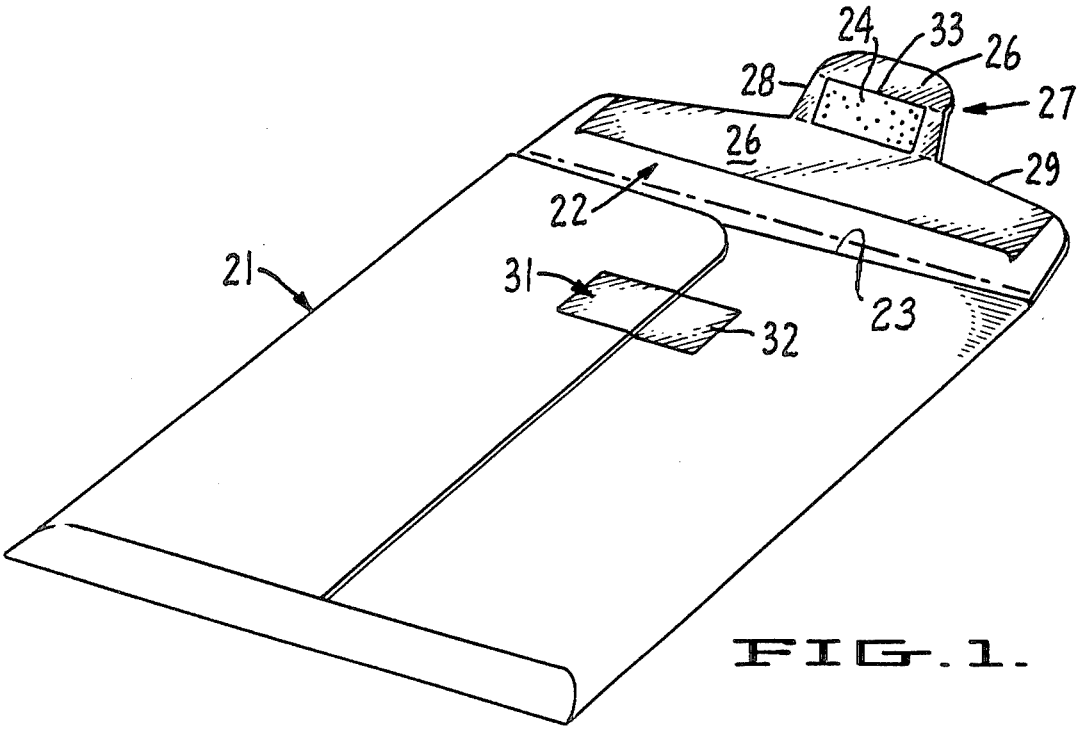
FIG. 1 is a perspective view of an envelope constructed in accordance with the present invention, with the flap of the envelope shown in open position.
Figure 2:
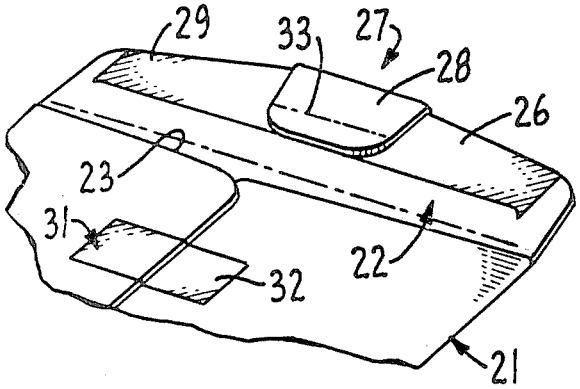
FIG. 2 is a fragmentary view of the flap end of the envelope of FIG. 1 illustrating a tab on the flap folded over to conceal and protect a pressure sensitive adhesive area on the tab.
Figure 3:
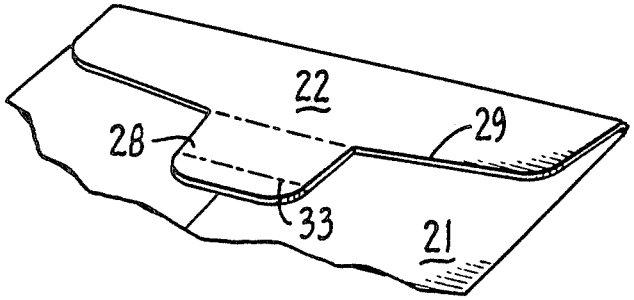
FIG. 3 is a view similar to that of FIG. 2, but showing the envelope flap folded down against the body of the envelope with the tab extended to bring the pressure sensitive are a into contact with the body of the envelope.
Figure 4:
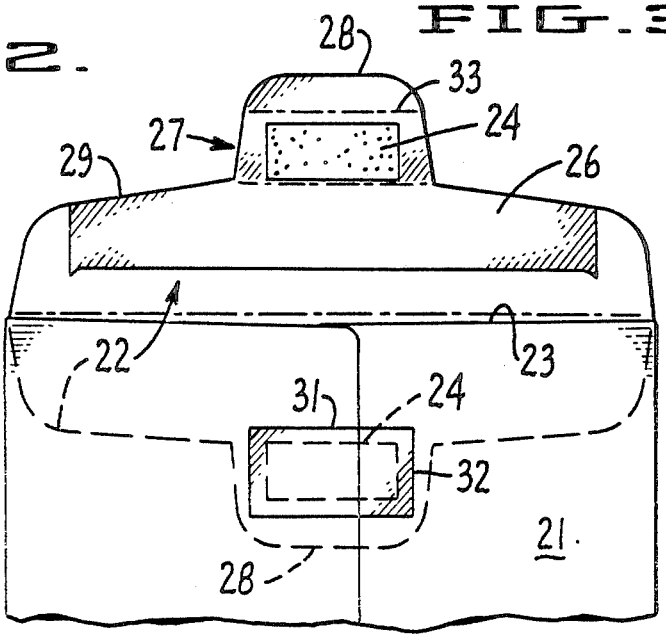
FIG. 4 is a partial plan view of the envelope of FIG. 1, with the flap and tab open, and with the position of the flap and tab shown in FIG. 3 illustrated in phantom lines.

While only the preferred forms of the invention are illustrated in the drawings, it will be apparent that various modifications could be made without departing from the ambit of the claims.

DESCRIPTION OF THE PREFERRED EMBODIMENTS

As may be seen in the accompanying drawings, the selectively temporarily and permanently sealable envelope or the like of the present invention provides a container body 21 for receiving and transporting desired contents, a closure flap 22 secured to the container body 21 adjacent to an opening 23 and foldable against body 21 for retaining such contents therein, a layer 24 of pressure sensitive adhesive covering an area of the flap 22 in position to engage the container body 21 when the flap 22 is folded against said body, a layer 26 of wettable dry adhesive covering an area of the flap 22 in position engage the container body 21 when flap 22 is folded against body 21, and means 27 for selectively masking off the layer 24 of pressure sensitive adhesive from the body 21 whereby the flap 22 is selectively and releasably securable to the body 21 by the layer 24 of pressure sensitive adhesive to provide a temporary seal and is permanently securable to body 21 by means of the layer 26 of dry wettable adhesive.

In accordance with the present invention and as an important feature thereof, a tab 28 is formed on the distal edge 29, extending therefrom, the tab 28 being foldable with regard to the flap 22 for masking off and concealing the layer 24 of pressure sensitive adhesive when folded. This avoids unwanted sticking of the pressure sensitive adhesive area 24 to the contents has they are being placed in or removed from the envelope body 21, and this also protects the "tackiness" or stickiness of the pressure sensitive adhesive 24 so it can be fresh for each reuse. This may be accomplished by providing material 31 having nn easy-release surface at the position on the container body 21 where the layer 24 of pressure sensitive adhesive is located when the tab 28 is unfolded and the flap 22 is folded. The material 31 should have a surface to which the pressure sensitive adhesive will adhere strongly enough to keep the flap 22 closed during normal use, but which will release the layer 24 of pressure sensitive adhesive without causing damage to the envelope body 21 or closure flap 22.

A suitable easy-release surface material is cellulose acetate tape having an adhesive which will not release easily from the envelope body, patches 32 of such tape being shown in various figures of the drawings.

An important feature of the invention, I have found that conventional wettable dry glue of the kind ordinarily used to seal envelopes provides a surface of the described "easy-release" type. The pressure sensitive adhesive will adhere to the dry glue surface, but may easily be stripped therefrom without damage to the envelope body 21, closure flap 22, or tab 28. Thus, the easy-release surface material 31 shown and described in the embodiments consists of both the patches 32 of cellulose tape and the layer 26 of dry wettable adhesive.

In the form of the invention illustrated in FIGS. 4–6, 8–10, and 12 of the drawings, the layer 24 of pressure sensitive adhesive occupies an area on the inner side of the tab 28 adjacent to the closure flap 22 whereby, when the tab 28 is folded against the flap 22, the layer 24 of the pressure sensitive adhesive is concealed between the tab 28 and the flap 22.

When the tab 28 is folded flat against the flap 22 or envelope body 21 and the layer 24 of pressure sensitive adhesive is releasably adhered, it is relatively difficult to grasp the tab 28 in order to lift it away from the surface to which it is adhered. Of course, a thin object such as a knife blade can easily be slipped between the dry glue portion of the tab and the confronting surface to assist in lifting the tab. However, in order to avoid having to use auxiliary tools, the tab 28 is here provided with a fold line 33, such as a scored line, at the side of the layer 24 of pressure sensitive adhesive remote from the flap 22 whereby, when the tab 28 is folded against the flap 22 the distal end of the tab 28 may be easily lifted from the flap 22 for grasping the tab 28 and stripping of the layer 24 of pressure sensitive adhesive thereon from the flap 22.

Figure 5:
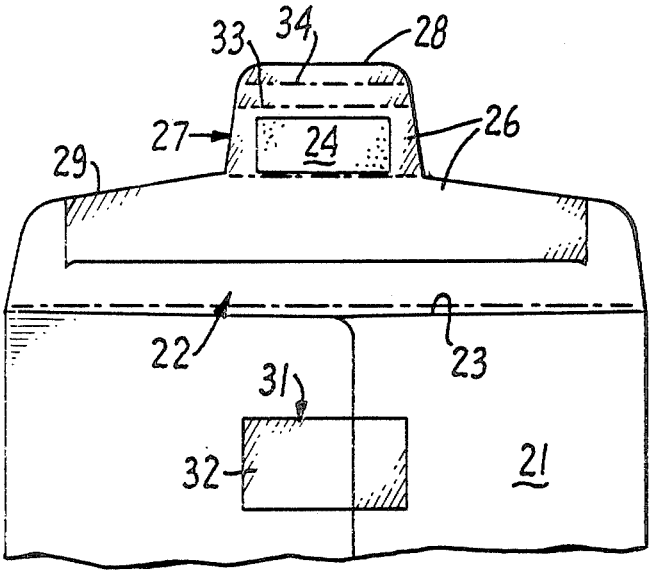
FIG. 5 is a view similar to that of FIG. 4, but illustrating the tab as being creased on opposite sides so as to provide fold lines facilitating lifting of the tab from the surface engaged by the pressure sensitive adhesive.
Figure 6:
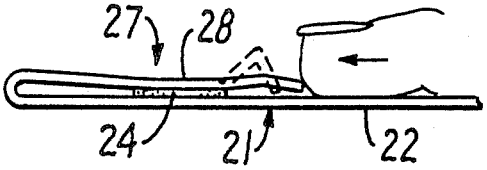
FIG. 6 is a vertical cross sectional view through the flap and tab portion of FIG. 5 illustrating the manner in which the finger of the user bends the distal portion of the tab in opposite directions.

In the form of the invention illustrated in FIGS. 5 and 6 of the accompanying drawings, the tab 28 is further provided with a reverse fold or scored line 34 in outwardly spaced generally parallel relation to the fold line 33 whereby pushing of a finger against the distal end of the tab 28 (when the latter is folded against the flap 22) causes the distal portion of the tab to come up to the position illustrated in dotted lines in FIG. 6 for easy grasping and lifting of the tab 28.

Figure 7:
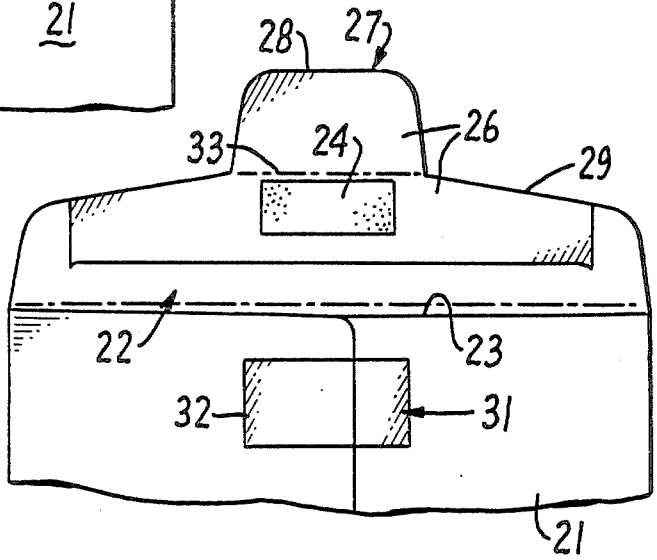
FIG. 7 is a view similar to that of FIG. 4, but illustrating the pressure sensitive adhesive area as being located on the flap rather than on the tab.

In the form of the invention illustrated in FIG. 7 of the drawings, the layer 24 of pressure sensitive adhesive is mounted on the flap 22 adjacent to the tab 28 in position to be concealed by the tab 28 when the latter is folded against the flap 22.

Figure 8:
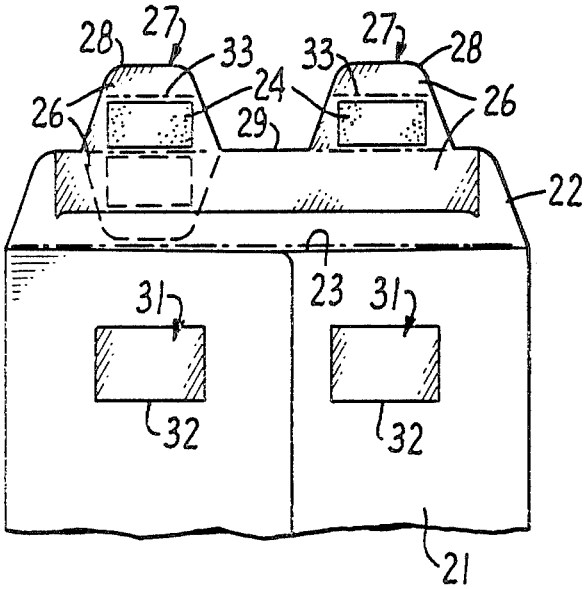
FIG. 8 is a view similar to that of FIG. 7, but illustrating a plurality of tabs formed along the distal edge of the envelope flap.

In the form of the invention illustrated in FIG. 8 of the drawings, a plurality of the tabs 28 are formed along the distal edge 29 of the flap 22. This is particularly valuable in connection with containers or the like having very wide openings closed by very long flaps, such as may be found in large size containers or long narrow containers having the opening flap along one of the longer sides. It should be noted that in the form of the invention illustrated in FIG. 8 of the drawings, a plurality of the patches 32 of easy-release material are positioned on the container body 21 at the positions contacted on the container body 21 by the layers 24 of pressure sensitive material when the tabs 28 are unfolded and the flap is folded.

Figure 9:
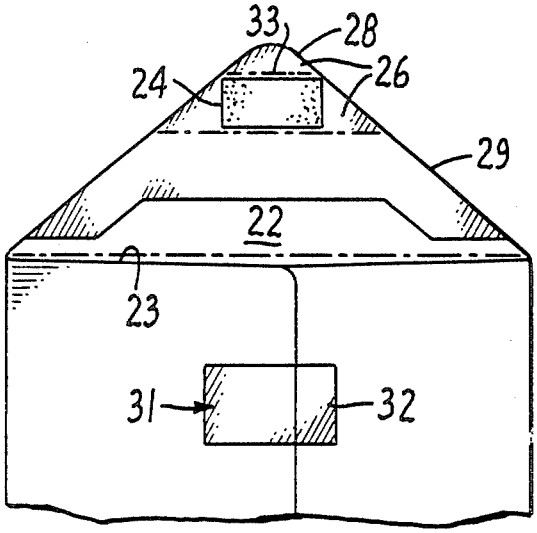
FIG. 9 is a view similar to that of FIG. 4, but illustrating a flap and tab combining to provide a triangular form.

In the form of the invention illustrated in FIG. 9 of the drawings, the closure flap 22 is triangular in form, and the distal pointed end of the flap 22 is foldable back on itself to provide a foldable tab 28.

Figure 10:
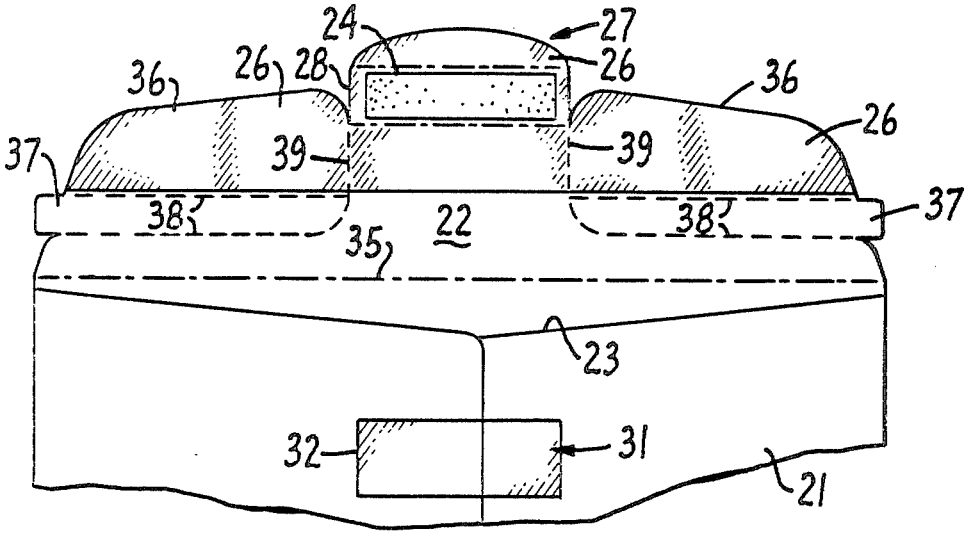
FIG. 10 is a view similar to that of FIG. 4, but illustrating lines of perforations making it possible to separate permanently sealed portions of the flap from the rest of the flap and tab.

As an important feature of the present invention, and as shown in FIG. 10 of the drawings, the envelope may be "permanently" sealed and yet still used thereafter in the temporary seal mode. To accomplish this, portions 36 of the flap are removable from the rest of the flap, including the tab 28. When the envelope is to be "permanently" sealed (that is when it is sealed so the envelope cannot be opened without damaging the integrity of the envelope body 21 or the flap 22), the dry adhesive on the shoulder portions 36 is wet, the flap is bent down at fold line 35 and the "permanent" sealing is accomplished in the usual way.

When it is desired to open the envelope of FIG. 10, a pair of tear strips 37, defined by lines of perforations 38 are torn out of flap 22 and the shoulder portions 36 are parted from the tab 28 along lines of perforations 39. In this manner, the tab 28 and the portion of the flap 22 separated from the shoulder portions 36 may be lifted, bent back, and the envelope reused with temporary sealing. Should it again be desired to seal the envelope permanently, the layer 26 of dry wettable adhesive on tab 28 is moistened, and the permanent seal is reestablished.

Figure 11:
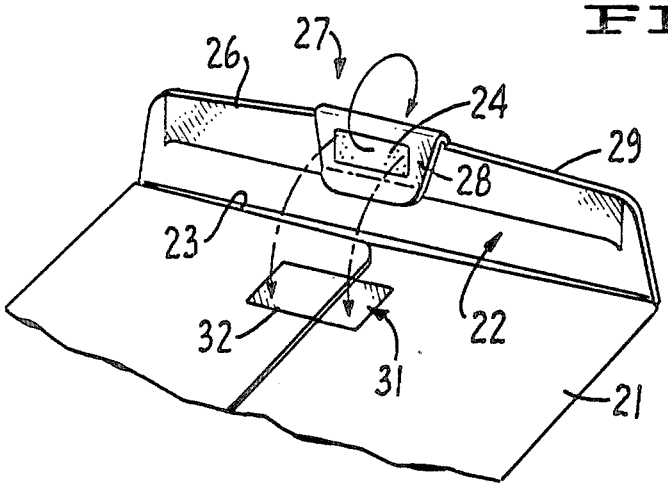
FIG. 11 is a partial perspective view of the flap and of a modified form of the invention in which the pressure sensitive adhesive is on the side of the tab opposite to that shown in FIG. 1 so that the tab may be folded under to the position shown where it will contact an easy-release surface on the envelope body when the flap is closed.

In the form of the invention illustrated in FIG. 11 of the drawings, the tab 28 is foldable to extend under the flap 22 when the latter is folded against the container body, and the layer 24 of pressure sensitive adhesive is mounted on the side of the tab 28 facing the container body 21 when the tab 28 is folded under the flap 22. The layer of easy-release material in the form of patch 32 is mounted on the container body 21 in position for engagement by the layer 24 of pressure sensitive adhesive when the tab 28 is folded under the flap 22.

Figure 12:
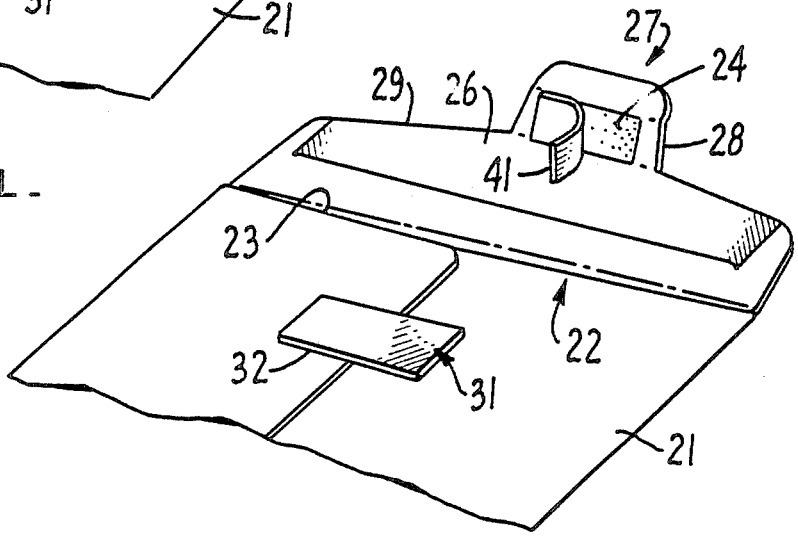
FIG. 12 is a fragmentary perspective view of the flap end of an envelope constructed in accordance with the present invention and illustrating the use of a protective strip removably mounted on the pressure sensitive adhesive to protect the latter until use.

In the form of the invention illustrated in FIG. 12 of the drawings, the layer 24 of pressure sensitive adhesive is further provided with a strip 41 of easy-release material which is removably mounted over the layer 24 of pressure sensitive adhesive until such time as the latter is to be used. In this form of the invention it is not necessary to fold the tab over to protect the pressure sensitive adhesive.

From the foregoing, it will be apparent that the selectively temporarily and permanently sealable envelope or the like of the present invention makes it possible to select whether the envelope is to be sealed permanently (meaning that it cannot be unsealed without damaging the envelope) or temporarily (meaning the envelope can be unsealed and the flap opened then resealed repeatedly), with all of this being accomplished in a thin, flat structure provided by the shape of the envelope, flap, and tab on the flap, together with discrete layers of pressure sensitive adhesive, wettable dry adhesive, and material having an easy-release surface.

What is claimed is:

1. A selectively temporarily and permanently sealable envelope or the like, comprising a container body for receiving and transporting desired contents a flap secured to said container body and foldable thereagainst for retaining such contents therein, a layer of pressure sensitive adhesive covering an area of said flap in position to engage said container body when said flap is folded against said body, and means for selectively masking off said layer of pressure sensitive adhesive from said body whereby said flap is selectively releasably securable to said container body by said pressure sensitive adhesive and is permanently securable to said container body by said wettable adhesive.

2. An envelope or the like as described in claim 1, and wherein a tab is formed on the distal edge of said flap and extending therefrom, said tab being foldable with regard to said flap for concealing said layer of pressure sensitive adhesive when folded.

3. An envelope or the like as described in claim 2, and wherein said layer of pressure sensitive adhesive releasably adheres to said layer of wettable dry adhesive when said tab is folded against said flap.

4. An envelope or the like as described in claim 2, and wherein unfolding of said tab exposes said layer of pressure sensitive adhesive for adherance to said container body when said flap is folded to lie against said container body.

5. An envelope or the like as described in claim 4, and wherein said container body is provided with material having an easy-release surface at the position on said container body where said layer of pressure sensitive adhesive is located when said tab is unfolded and said flap is folded.

6. An envelope or the like as described in claim 2, and wherein said layer of pressure sensitive adhesive occupies an area on the inner side of said tab adjacent to said flap whereby when said pressure sensitive adhesive is concealed between said tab and said flap.

7. An envelope or the like as described in claim 6, and wherein said tab is provided with a fold line at the side of said pressure sensitive adhesive remote from said flap whereby when said tab is folded against said flap the distal end of said tab may be lifted from said flap for grasping said tab and stripping of said pressure sensitive adhesive thereon from said flap.

8. An envelope or the like as described in claim 7, and wherein said layer of pressure sensitive adhesive removably adheres to said layer of dry wettable adhesive on said flap when said tab is folded against said flap.

9. An envelope or the like as described in claim 7, and wherein said tab is further provided with a reverse fold line in outwardly spaced generally parallel relation to said fold line at the side of said pressure sensitive adhesive remote from said flap whereby pushing of a finger against the distal end of said tab when the latter is folded against said flap causes the distal portion of said tab to hump up for easy grasping.

10. An envelope or the like as described in claim 2, and wherein said layer of pressure sensitive adhesive is mounted on said flap adjacent to said tab in position to be concealed by said tab when the latter is folded against said flap.

11. An envelope or the like as described in claim 10, and wherein unfolding of said tab exposes said layer of pressure sensitive adhesive for adherance to said container body when said flap is folded to lie against said container body.

12. An envelope or the like as described in claim 11, and wherein said container body is provided with material having an easy-release surface at the position on said container body where said layer of pressure sensitive adhesive is located when said tab is unfolded and said flap is folded.

13. An envelope or the like as described in claim 5, and wherein a plurality of said tabs are formed along the distal edge of said flap, and a corresponding plurality of said patches of easy-release material are positioned on said container body at the positions contacted on said container body by said pressure sensitive material when said tabs are unfolded and said flap is folded.

14. An envelope or the like as described in claim 1, and wherein said flap is triangular in form, and the distal pointed end of said flap is foldable back on itself to provide a foldable tab.

15. An envelope or the like as described in claim 1, and wherein said flap is provided with perforations defining a central tab flanked by shoulder portions separable from said tab and from the rest of said flap along said perforations, said tab being foldable with regard to said flap for concealing said layer of pressure sensitive adhesive when folded.

16. An envelope or the like as described in claim 15, and wherein said layer of pressure sensitive adhesive releasably adheres to said layer of wettable dry adhesive when said tab is folded against said flap.

17. An envelope or the like as described in claim 16, and wherein unfolding of said tab exposes said layer of pressure sensitive adhesive for adherance to said container body when said flap is folded to lie against said container body.

18. An envelope or the like as described in claim 17, and wherein said container body is provided with material having an easy-release surface at the position on said container body where said layer of pressure sensitive adhesive is located when said tab is unfolded and said flap is folded.

19. An envelope or the like as described in claim 18, and wherein said perforations are formed to define a pair of manually engageable tear strips separating said shoulder portions from said flap, and said shoulder portions are coated with said layer of dry wettable adhesive whereby said shoulder portions are capable of being permanently adhered to said container body and said tab and the balance of said flap are capable of being separated from said shoulder portions for repeated opening and sealing of said container body.

20. An envelope or the like as described in claim 19, and wherein said tab is provided with areas of pressure sensitive adhesive for temporary sealing of said tab and with areas of dry wettable adhesive for permanent sealing of said tab.

21. An envelope or the like as described in claim 1, and wherein a tab is formed on the distal edge of said flap and extending therefrom, said tab being foldable to extend under said flap when the latter is folded against said container body, said layer of pressure sensitive adhesive being mounted on the side of said tab facing said container body when said tab is folded under said flap, and wherein a layer of easy-release material is mounted on said container body in position for engagement by said layer of pressure sensitive adhesive when said tab is folded under said flap.

22. An envelope or the like as described in claim 2, and wherein a tab is found on the distal edge of said flap and extending therefrom, said layer of pressure sensitive material being mounted on the side of said tab facing said container body when said flap is folded thereagainst, a layer of quick-release material is mounted on said body in position for engagement by said layer of pressure sensitive adhesive when said flap is folded, and an easily removable strip of quick-release material is adhered to said layer of pressure sensitive adhesive.

* * * * *